US009681741B2

(12) United States Patent
Flannery

(10) Patent No.: US 9,681,741 B2
(45) Date of Patent: Jun. 20, 2017

(54) GRILL CLEANER

(71) Applicant: William Sheftall Flannery, Silver Spring, MD (US)

(72) Inventor: William Sheftall Flannery, Silver Spring, MD (US)

( * ) Notice: Subject to any disclaimer, the term of this patent is extended or adjusted under 35 U.S.C. 154(b) by 68 days.

(21) Appl. No.: 14/668,898

(22) Filed: Mar. 25, 2015

(65) Prior Publication Data

US 2015/0272311 A1 Oct. 1, 2015

(51) Int. Cl.

| | |
|---|---|
| ***A46B 7/04*** | (2006.01) |
| ***A46B 15/00*** | (2006.01) |
| ***A47L 13/06*** | (2006.01) |

(52) U.S. Cl.

CPC ..... *A46B 7/042* (2013.01); *A46B 7/04* (2013.01); *A46B 15/001* (2013.01); *A46B 2200/30* (2013.01); *A46B 2200/3033* (2013.01); *A46B 2200/3093* (2013.01); *A47L 13/06* (2013.01)

(58) Field of Classification Search

CPC .. A46B 7/04; A46B 7/042; A46B 9/08; A46B 9/12; A46B 15/001; A46B 2200/30; A46B 2200/3073; A46B 2200/3093; A47L 13/06

USPC ..... 15/111, 160, 176.1, 176.4–176.6, 200, 15/202, 168, 169

See application file for complete search history.

(56) References Cited

U.S. PATENT DOCUMENTS

| | | | | |
|---|---|---|---|---|
| 499,678 | A * | 6/1893 | Long | A46B 9/08 15/168 |
| 1,809,974 | A * | 6/1931 | Jones | A46B 9/08 15/168 |
| 4,912,801 | A * | 4/1990 | Hammill | A46B 9/02 15/105 |
| 5,247,718 | A * | 9/1993 | Victorian | A46B 7/04 15/167.1 |
| 5,373,600 | A * | 12/1994 | Stojanovski | A47L 17/00 15/111 |
| 5,860,183 | A | 1/1999 | Kam | |
| 6,421,872 | B1 | 7/2002 | Sciandivasci | |
| 8,615,838 | B1 * | 12/2013 | Lu | A47L 13/12 15/111 |
| 8,806,698 | B2 * | 8/2014 | Enders | A47J 37/0786 15/111 |

(Continued)

FOREIGN PATENT DOCUMENTS

| | | |
|---|---|---|
| CA | 2379736 | * 9/2003 |
| FR | 384303 | * 4/1908 |
| GB | 681606 | * 10/1952 |

*Primary Examiner* — Mark Spisich

(74) *Attorney, Agent, or Firm* — Dunlap Bennett & Ludwig PLLC

(57) ABSTRACT

A grill cleaner with a handle and a head is provided. The handle includes a first end and a second end. The head is attached to the second end of the handle. The present invention further includes a grill brush including a block and a plurality of bristles protruding from the block. The grill brush is removeably attached to the head so that the grill brush may be easily replaced once the bristles have been worn down. A bristle wear indicator is attached to and protrudes from the head beyond the block and ending at a plane in between a first end of the plurality of bristles and a second end of the plurality of bristles. Therefore, once the bristles have worn down to the plane, the user is indicated to replace the grill brush.

10 Claims, 4 Drawing Sheets

(56) References Cited

U.S. PATENT DOCUMENTS

| | | | | |
|---|---|---|---|---|
| 2006/0080797 | A1* | 4/2006 | Yu | A46B 7/04<br>15/176.4 |
| 2012/0060864 | A1 | 3/2012 | Nowakowski | |
| 2014/0331424 | A1* | 11/2014 | Gonzalez | A46B 3/18<br>15/111 |

* cited by examiner

GRILL CLEANER

CROSS-REFERENCE TO RELATED APPLICATION

This application claims the benefit of priority of U.S. provisional application No. 61/970,191, filed Mar. 25, 2014, the contents of which are herein incorporated by reference.

BACKGROUND OF THE INVENTION

The present invention relates to a grill cleaner and, more particularly, to a grill cleaner with a removable brush and a bristle wear indicator.

Grill cleaners typically include a brush with metal bristles. The grill is usually turned on and heated. Once the grill has been sufficiently heated, the grid iron of the grill is brushed with the metal bristles. Due to the heat and the rubbing back and forth, the metal bristles tend to wear down. However, since there is currently no indicator of when to replace the brush, users may continue to use a worn out brush to clean their grill. The user is thereby wasting time and ineffectively cleaning their grill.

As can be seen, there is a need for a grill brush that indicates when the brush needs to be replaced.

SUMMARY OF THE INVENTION

In one aspect of the present invention, a grill cleaner comprises: a handle having a first end and a second end; a head attached to the second end of the handle; a grill brush comprising a block and a plurality of bristles, wherein the grill brush is removably attachable to the head; and a bristle wear indicator attached to and protruding from the head beyond the block and ending at a plane in between a first end of the plurality of bristles and a second end of the plurality of bristles.

These and other features, aspects and advantages of the present invention will become better understood with reference to the following drawings, description and claims.

DETAILED DESCRIPTION OF THE INVENTION

Figures 1, 2:
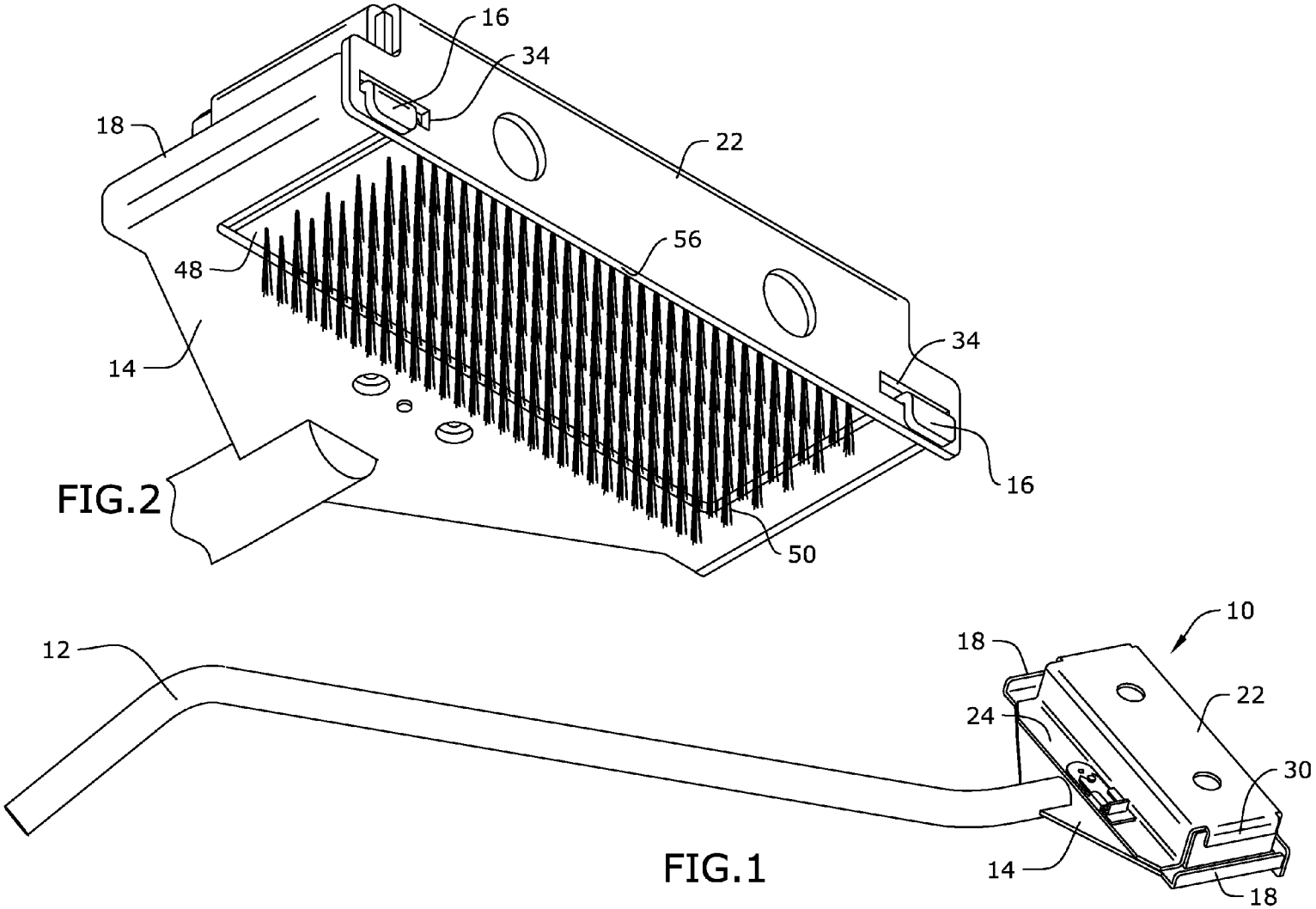
FIG. 1 is a perspective view of an embodiment of the present invention.
FIG. 2 is a lower perspective detail view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring to FIGS. 1 through 12, the present invention includes a grill cleaner with a handle 12 and a head 10. The handle 12 includes a first end and a second end. The head 10 is attached to the second end of the handle 12. The present invention further includes a grill brush 15 including a block 48 and a plurality of bristles 50 protruding from the block 48. The grill brush 15 is removeably attached to the head 10 so that the grill brush 15 may be easily replaced once the bristles 50 have been worn down. A bristle wear indicator 56 is attached to and protrudes from the head 10 beyond the block 48 and ending at a plane in between a first end of the plurality of bristles 50 and a second end of the plurality of bristles 50. Therefore, once the bristles 50 have worn down, the user is indicated to replace the grill brush 15.

In certain embodiments, the head 10 of the present invention may include a lower plate 14 and an upper plate 22. The upper plate 22 and the lower plate 14 may be pivotally connected together. The present invention may include an open position and a closed position. A latch 40 is operable to lock the upper plate 22 and the lower plate 14 together in the closed position, preventing the plates 14, 22 from pivoting and thereby securing the grill brush 15 in between. The open position includes an unlocked latch 40 and the upper plate 22 and the lower plate 14 pivoted away from one another. The open position exposes the grill brush 15 so that the grill brush 15 may be removed and replaced. The closed position includes the upper plate 22 and the lower plate 14 pivoted together, and the latch 40 locked. The closed position may secure the grill brush 15 within the head 10 and the grill cleaner may be used to clean a grill surface 54.

Figure 3:
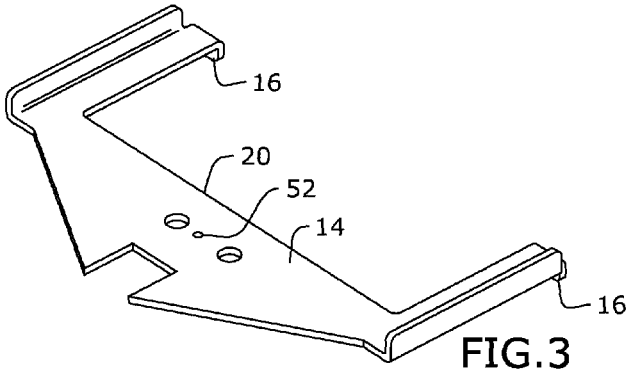
FIG. 3 is a top perspective view of a lower plate of an embodiment of the present invention.
Figure 4:
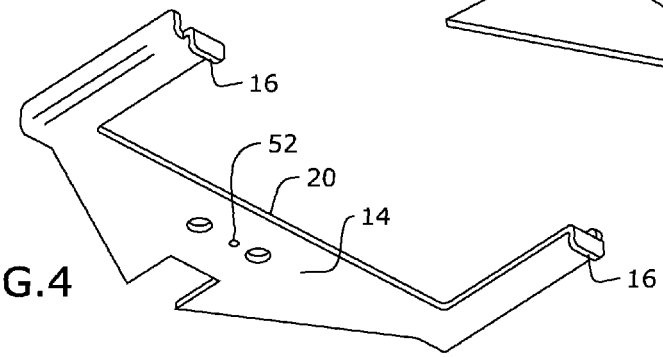
FIG. 4 is a lower perspective view of a lower plate of an embodiment of the present invention.

As illustrated in FIGS. 3 and 4, the lower plate 14 includes a front portion and a rear portion opposite the front portion. The rear portion may be connected to the handle 12. The front portion may include at least one hook 16, such as two hooks 16 protruding downward and substantially perpendicular to the lower plate 14. The lower plate 14 may further include an inner rim 20 forming an opening. The block 48 is sized to rest on the inner rim 20 and the opening is sized to receive the plurality of bristles 50 therethrough. The lower plate 14 may also include retaining flanges 18 protruding upward and opposite the hooks 16. The retaining flanges 18 may protrude from an outer edge of the lower plate 14, thereby securing the block 48 in between.

Figure 5:
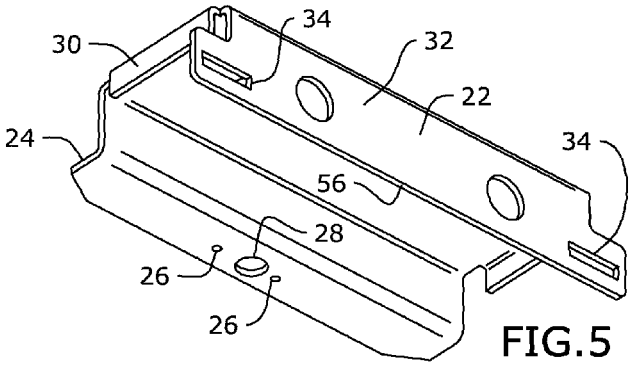
FIG. 5 is a lower perspective view of an upper plate of an embodiment of the present invention.
Figure 6:
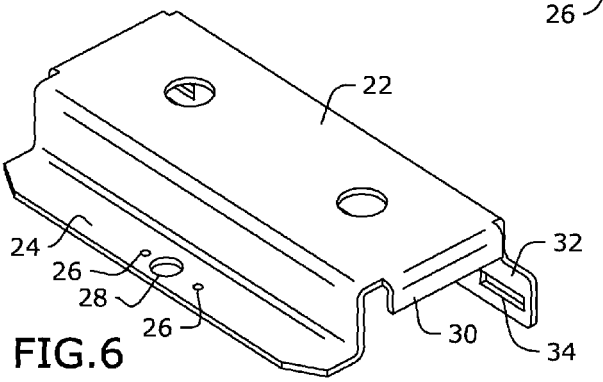
FIG. 6 is a top perspective view of an upper plate of an embodiment of the present invention.
Figure 7:
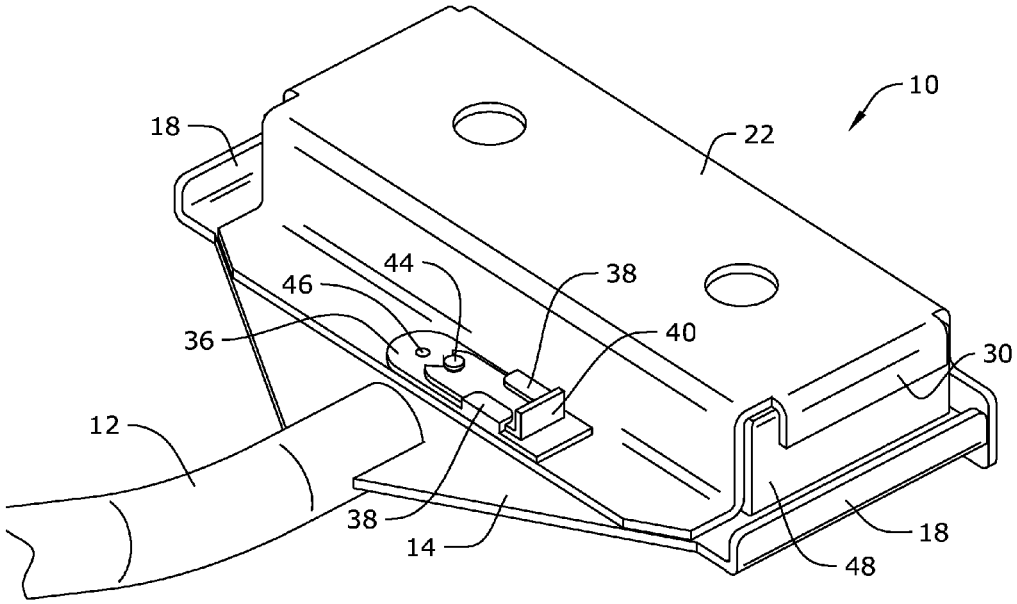
FIG. 7 is a top perspective view of an upper plate and a lower plate latched together.
Figure 8:
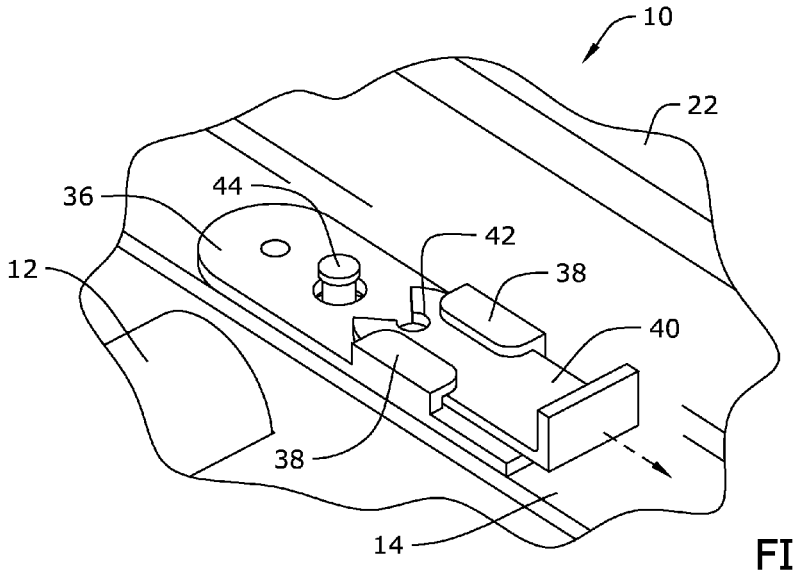
FIG. 8 is a top detail view of a latch disengaged.
Figure 9:
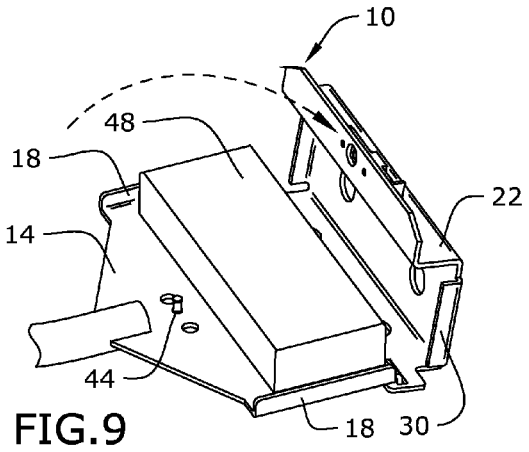
FIG. 9 is a top perspective view of an upper plate and a lower plate pivoting away from one another.
Figure 10:
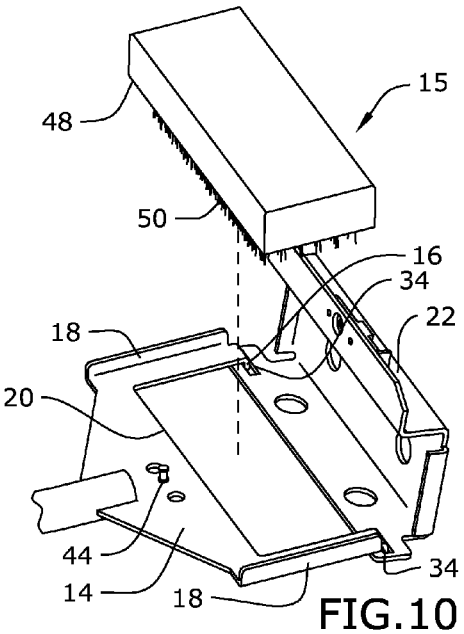
FIG. 10 is a top perspective exploded view of the removal of a brush.
Figure 11:
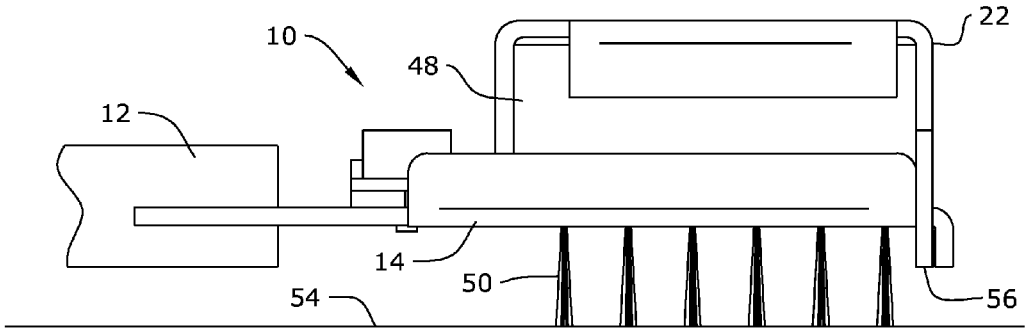
FIG. 11 is a side view of an embodiment of the present invention in use.
Figure 12:
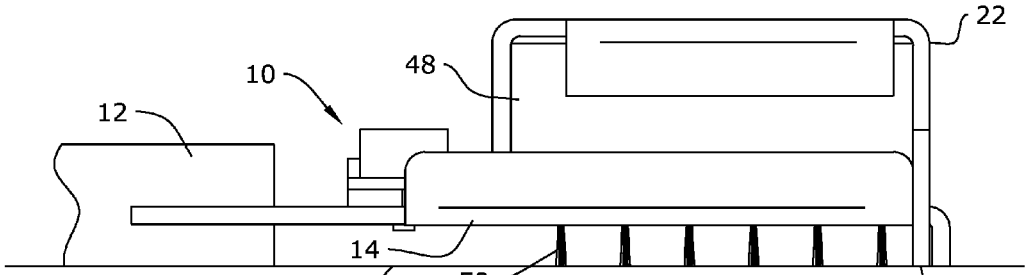
FIG. 12 is a side view of an embodiment of the present invention shown with bristles worn down.

As illustrated in FIGS. 5 and 6, the upper plate 22 includes a front portion and a rear portion opposite the front portion. A front flange 32 may protrude downward from the upper plate at the front portion, and a rear flange may protrude downward from the upper plate at the rear portion. The front flange 32 may include at least one slot 34, such as two slots 34, that receive and secure the hooks 16 within, thereby pivotally joining the lower plate 14 and upper plate 22. The front flange 32 may also form the bristle wear indicator 56. The upper plate 22 may include retaining flanges 30 protruding downward. The retaining flanges 30 may protrude from an outer edge of the upper plate 22, thereby securing the block 48 in between.

As mentioned above the locking mechanism may include a latch 40. The upper plate 22 may include a lock flange 24 extending from and substantially perpendicular to the rear flange. Rivet holes 26 and a bushing hole 28 may be formed through the lock flange 24. A latch plate 36 may be secured to the lock flange 24 via rivets 46 secured through the latch plate 36 and into the rivet holes 26. The latch plate 36 may include a bushing hole that aligns with the bushing hole 28 of the lock flange 26. Latch plate arms 38 may extend from the latch plate 36 and slidably retain the latch 40 within. The lower plate 14 may include a bushing 44 secured within a bushing retaining aperture 52. When in the closed position, the upper plate 22 is pivoted towards the lower plate 14 so that the bushing 44 runs through the aligning bushing holes 28. The latch 40 may slide towards the bushing 44 and secure the bushing 44 within a latch slot 42 formed at an end of the latch 40. The upper plate 22 and the lower plate 14 are thereby locked together. To unlock, the latch 40 may slide in an opposite direction, releasing the bushing from the latch slot 42. The upper plate 22 is thereby free to pivot away from the lower plate 14.

The present invention may include grips that are added to make the brush more comfortable to use. Cooking instructions or safety instructions could be printed on the head. The handle could be lengthened or adjustable. Further, the clamp wear indicator and brush assembly could be modified to fit other high use cleaning components that wear out.

It should be understood, of course, that the foregoing relates to exemplary embodiments of the invention and that modifications may be made without departing from the spirit and scope of the invention as set forth in the following claims.

What is claimed is:

1. A grill cleaner comprising:

a handle having a first end and a second end;

a head attached to the second end of the handle, wherein the head comprises a lower plate, an upper plate, and a latch operable to lock the upper plate and the lower plate together; and a grill brush comprising a block and a plurality of bristles, wherein the grill brush is secured to the head in between the upper plate and the lower plate;

wherein the upper plate comprises a front flange forming a bristle wear indicator, wherein the bristle wear indicator protrudes downward beyond the block and ends at a plane in between a first end of the plurality of bristles and a second end of the plurality of bristles.

2. The grill cleaner of claim 1, wherein the grill brush is removably attachable to the head.

3. The grill cleaner of claim 1, wherein the upper plate and the lower plate are pivotally connected together.

4. The grill cleaner of claim 1, wherein the lower plate comprises at least one hook and the upper plate comprises at least one slot sized to receive and pivotally connect the lower plate and the upper plate.

5. The grill cleaner of claim 4, wherein the front flange comprises the at least one slot sized to retain the at least one hook.

6. The grill cleaner of claim 1, wherein the lower plate comprises an inner rim forming an opening, wherein the block is sized to rest on the inner rim and the opening is sized to receive the plurality of bristles therethrough.

7. The grill cleaner of claim 1, wherein the lower plate comprises a bushing, and the upper plate comprises a lock flange comprising an opening aligning with the bushing, wherein when the lower plate and the upper plate are pivoted together, the latch is operable to secure the bushing within.

8. The grill cleaner of claim 7, wherein the latch is attached to and is slidably engaged with the flange of the upper plate.

9. A grill cleaner comprising:

a handle having a first end and a second end;

a head attached to the second end of the handle, wherein the head comprises a lower plate comprising at least one hook, an upper plate comprising at least one slot, and a latch operable to lock the upper plate and the lower plate together, wherein the at least one slot receives and pivotally connects the lower plate and the upper plate;

a grill brush comprising a block and a plurality of bristles, wherein the grill brush is secured to the head in between the upper plate and the lower plate; and a bristle wear indicator attached to and protruding from the head beyond the block and ending at a plane in between a first end of the plurality of bristles and a second end of the plurality of bristles.

10. A grill cleaner comprising:

a handle having a first end and a second end;

a head attached to the second end of the handle, wherein the head comprises a lower plate and an upper plate, and a latch, wherein the lower plate comprises a bushing, and the upper plate comprises a lock flange comprising an opening aligning with the bushing, wherein when the lower plate and the upper plate are pivoted together, the latch is operable to secure the bushing within;

a grill brush comprising a block and a plurality of bristles, wherein the grill brush is secured to the head in between the upper plate and the lower plate; and a bristle wear indicator attached to and protruding from the head beyond the block and ending at a plane in between a first end of the plurality of bristles and a second end of the plurality of bristles.

* * * * *